United States Patent [19]

Lattanzi

[11] Patent Number: 4,537,007

[45] Date of Patent: Aug. 27, 1985

[54] PROCESS AND PLANT FOR ENDLESS-CYCLE STERILIZATION OF SHEET MATERIAL UTILIZED IN ASEPTIC PACKAGING OF PRE-STERILIZED FLUID PRODUCTS

[76] Inventor: Ettore Lattanzi, Via Caprera, 1, Parma, Italy, 43100

[21] Appl. No.: 459,968

[22] Filed: Jan. 21, 1983

[30] Foreign Application Priority Data

Jan. 29, 1982 [IT] Italy ..... 40007 A/82

[51] Int. Cl.[3] ..... B65B 55/02

[52] U.S. Cl. ..... 53/425; 53/552

[58] Field of Search ..... 53/551, 552, 167, 425, 53/426; 422/26, 27

[56] References Cited

U.S. PATENT DOCUMENTS

| | | | |
|---|---|---|---|
| 3,466,841 | 9/1969 | Rausing | 53/426 |
| 3,820,300 | 6/1974 | Reinecke et al. | 53/425 |
| 4,376,681 | 3/1983 | Inoue et al. | 422/26 |
| 4,417,607 | 11/1983 | Scholle et al. | 53/167 |

*Primary Examiner*—Francis S. Husar

*Assistant Examiner*—Jorji M. Griffin

*Attorney, Agent, or Firm*—Darby & Darby

[57] ABSTRACT

The invention relates to a process for endless-cycle sterilization of the sheet material utilized in aseptic packaging of pre-sterilized fluid food-stuffs, and to plant therefor. The process involves sterilization of a continuous sheet of material—caused subsequently to assume tubular format—by means basically of its being bathed on both sides and then sprayed with superheated steam jetted likewise at either side. Following such heat treatment, the sheet is shaped into a continuous tube and filled, this dual operation coming about within an enclosure maintained in sterile conditions. Plant for carrying the process into effect basically comprises a first chamber (3) inside which the alreadly-bathed sheet (1) is sprayed with steam, and a second chamber (5) inside which sterile conditions are maintained, wherein the sheet is duly shaped into a tube (10) and filled. The first chamber entry point is by way of a siphon trap (8), and the first and second chambers are pressurized to a given level and equalized thus during the plant's operation.

11 Claims, 1 Drawing Figure

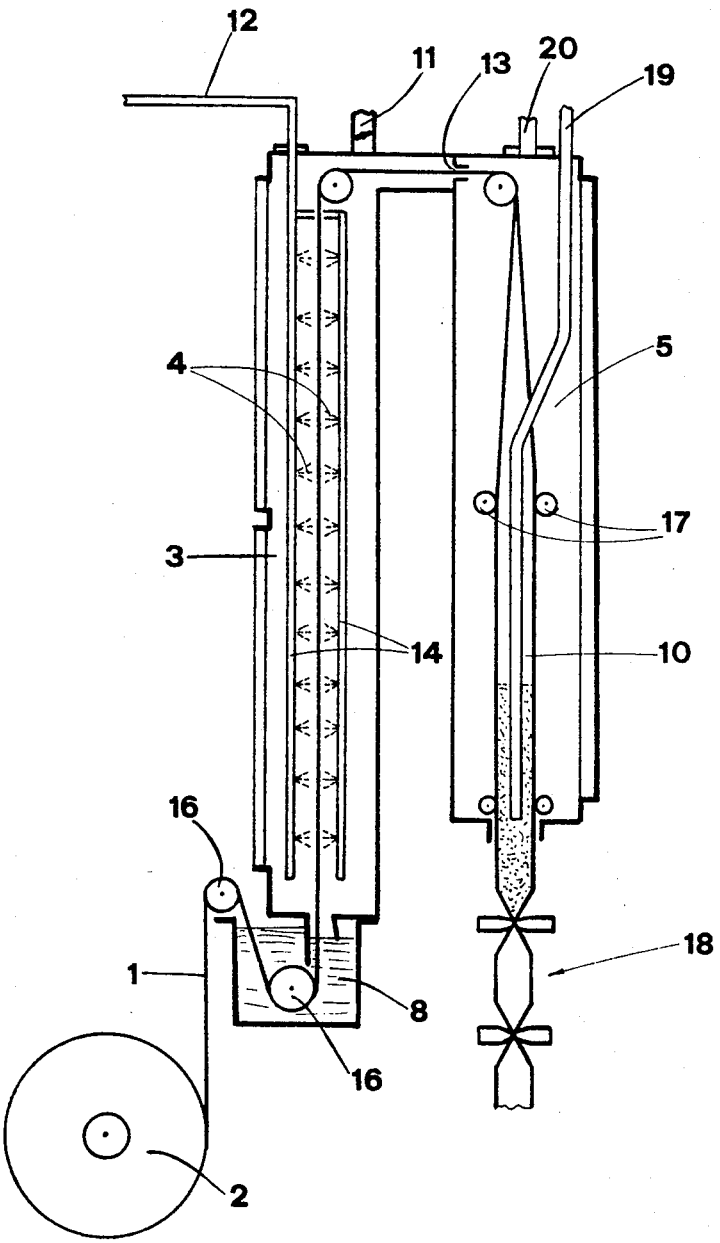
12
11
13
20
19
4
5
17
3
14
10
16
18
1
8
16
2

PROCESS AND PLANT FOR ENDLESS-CYCLE STERILIZATION OF SHEET MATERIAL UTILIZED IN ASEPTIC PACKAGING OF PRE-STERILIZED FLUID PRODUCTS

BACKGROUND OF THE INVENTION

The invention described herein relates to a process for endless-cycle sterilization of the sheet material utilized for packaging pre-sterilized fluids in aseptic conditions, and sets forth plant for the purpose.

In the packaging processes normally emoloyed for pre-sterilized products such as milk, juices, &c., it is usual to find a continuous belt, or sheet of material consisting—generally speaking—of a number of layers of paper, synthetic film, super-thin metallic membrane and the like, whose edges are heat-sealed together so as to form a tube with which to fill the already sterilized fluid product. With the tube thus created, single packs are then formed containing the requisite quantity of fluid. It will be clear enough that the tube, which must then come into contact with the pre-sterilized product, will need to be sterile likewise, so as to enable the fluid's being preserved in good condition for an appreciable length of time.

In order to bring about sterilization of the continuous sheet thus used in packaging foodstuffs, one has an existing process which is chemical by definition, and consists in an initial dampening of the sheet in a chemical sterilizer, followed by its being warmed in such a way as to bring about the evaporation of the sterilizer and produce a reaction which duly sterilizes the sheet by chemical means. This particular process is less than satisfactory, since it is extremely difficult to remove all traces of the chemical sterilizer—which tend to appear in the packaged contents on subsequent inspection.

One object of the invention described herein is that of providing a sterilization process, and plant therefor, which involves no use whatever of chemical substances for bringing about sterilization of the sheet material, and which at the same time avoids any disturbance to the properties of the material itself needing sterilization.

A further object of the invention is that of embodying plant for carrying out the process as set forth, whose construction will be characterized by extreme simplicity and economy, and whose actual function will likewise be simple in the extreme.

SUMMARY OF THE INVENTION

The above objects and others besides are in fact realized by the process and plant to which the invention refers, being of a type utilizing an endless sheet of material for subsequent shaping into a tube, and characterized in that the process itself comprises the following stages:

bathing of the sheet on both sides;

application of heat to both sides of the sheet by means of superheated steam, this being brought about within a first enclosure inside which the steam is maintained at a pressure-value slightly in excess of the enclosure's surroundings, and for a length of time per section of sheet sufficient to ensure the latter's being sterilized;

shaping of the tube and filling of same with the product, this dual operation being performed by conventional devices within a second enclosure into which sterile gas is introduced in such a way as to maintain aseptic conditions therein, the gas being held at a pressure-value slightly in excess of the second enclosure's immediate surroundings;

creation of the single packages by conventional means, brought about in atmospheric conditions.

BRIEF DESCRIPTION OF THE DRAWING

Further features and advantages will emerge more clearly from the detailed description which follows of a preferred embodiment of the plant, and of the process itself.

A single drawing is attached which shows a diagram of the plant in vertical elevation.

DESCRIPTION OF THE PROCESS AND OF THE PREFERRED EMBODIMENT OF PLANT THEREFOR

The process to which the invention relates envisages the sheet material's being bathed with water—hot water in point of fact kept at a temperature slightly below boiling—i.e. 100° C. the sheet being bathed on both sides by way of its being immersed completely in the water. Following immersion, superheated steam is directed at the sheet which both sterilizes and dries either side thereof. The temperature of the steam may be kept reasonably low—somewhere between 130° and 180° C. —since it is common knowledge that bacteria become weaker in damp surroundings; thus sterilization of the sheet may be brought about at a relatively low working heat. This steam heat-treatment comes about within a first enclosure, the steam itself being pressurized to a value slightly in excess of the surrounding atmosphere so as to avoid contamination as a result of infiltration of the air outside into the enclosure itself.

This completed, the sheet is then shaped into a continuous tube and filled with the fluid foodstuff, this combined operation being carried out with the use of conventional devices, within a second enclosure—this in receipt of sterile gas compressed thereinto in such a way as to maintain a pressure-value slightly higher than that of the surrounding atmosphere. The pressurization of this second enclosure likewise serves to avoid any possible contamination due to the influx of air from the surrounding atmosphere. The gas itself, which might be sterile air, for instance, is introduced at ambient temperature.

It is also envisaged that pressure values in both first and second enclosures should be equalized, one with the other, so as to avoid (a) the entry of sterile air into the first enclosure, with a consequent drop in temperature which will jeopardize perfect sterilization, and (b) the entry of steam into the second enclosure, with the result that moisture will form therein following condensation of the steam.

The plant which would carry out such a process as that described utilizes a continuous sheet 1 of packaging material wound off from a reel 2. The plant itself basically comprises a first chamber 3 and a second chamber 5 communicating with each other by way of a bottleneck section 13, and disposed on a vertical axis, parallel with each other. The sheet of material passes along within the two chambers, ascending within said chamber 3, and descending through chamber 5.

The first chamber 3 houses first means of sterilization cosisting of a number of spray nozzles 4 located in opposition one to the other and defining a vertical rectilinear path along whose center the sheet 1 is caused to run. Said nozzles 4 are fitted to a pair of pipes 14 into which superheated steam is directed through a manifold 12 from a unit not shown in the drawing.

Means for bathing the sheet are located at a point prior to the sheet's entry into chamber 3, and consist of a tank 8 containing the appropriate liquid, which generally speaking will be water, heated to temperature marginally below boiling point (100° C.). The tank's position is directly below the lower end of first chamber 3, and sheet 1 passes through the liquid contained therein by means of its passing around drive rollers 16. The tank 8 itself is embodied as a siphon through which the sheet is obliged to pass before entering chamber 3, thus, besides bathing the sheet, an airtight barrier is produced between said first chamber 3 and the surrounding atmosphere.

The second chamber 5 houses means for shaping the sheet 1 into a tube 10, as well as for filling same with the fluid product to be packaged; said means being of a conventional type used in existing plant of a similar kind, and denoted in the drawing 17 and 19, representing shaper-rollers and fluid feeder-tube, respectively.

The upper region of second chamber 5 is fitted with an entry pipe 20 through which sterile gas is sent into the chamber in such a way as to create a slight pressurization with respect to the surrounding atmosphere. The gas itself could be sterile air held at ambient temperature.

Means for creating the individual packs are located downflow of the second chamber 5, these being likewise of a conventional type, and denoted 18 in the drawing, located externally of the actual enclosure defined by chamber 5.

A breather 11 is located at the upper region of first chamber 3, whose aperture is both adjustable, and workable by means of automatic components not illustrated in the drawing whose function will be dicatated by the pressure level within said second chamber 5. With this arrangement, correct adjustment of the breather 11 port will enable a regular equalization of the excess pressure-values in both chambers 3 and 5.

The plant thus described functions as follows: a preliminary sterilization of both chambers will be carried out, by flooding with steam, for instance, after which sterile air will be introduced into chamber 5 so as to create the appropriate sterile conditions therein, at low temperature. Pressure is then equalized in the two chambers by means of breather 11, as described beforehand. Bottleneck 13 is of sufficiently small section to connect the two chambers without any mingling of the two differing atmospheres created therein. This mix must clearly be avoided since an influx of cold sterile air into chamber 3 would give rise to a fall in temperature in the enclosure, inhibiting the chamber's ability to sterilize the sheet efficiently; likewise, the entry into chamber 5 of steam would bring about damp conditions in the second enclosure.

The sheet of material 1 winds in an endless fashion from reel 2 so as to create a continuous tube which may eventually be cut into single packs by the appropriate means 18, passing at first through tank 8 and being bathed on either side. Thus bathed, the sheet enters first chamber 3 and is directed along between the spray nozzles 4 which jet superheated steam onto both sides thereof, the steam both drying the sheet and sterilizing it. With this purpose in mind, the extent of travel established by the lines of nozzles 4—and indeed the length of the chamber 3 itself—will be sufficient to ensure that the sheet material's contact with the jetted steam is extended enough to bring about the desired drying and sterilizing action. What is more, the super-heated steam issuing from nozzles 4 will be such as to maintain chamber 3 in slight overpressure, thereby avoiding any possibility of its being contaminated with air infiltrating from the outside. Likewise, the siphon bather tank 8 is embodied so as to permit entry of the sheet into chamber 3 without there being any influx of air to the enclosure by that same route.

The sterilized sheet passes into second chamber 5 whose interior is maintaned in a sterile condition by virtue of the gas which is introduced through entry pipe 20. The sheet is shaped into a tube once inside the enclosure, and filled with whatever fluid product happens to have been prepared for packaging. The filled tube 10 then exits from chamber 5, whereupon its outer surface comes into contact with the outside air. This causes no damage whatsoever to the tube, since its inner surface which makes contact with the foodstuff will at no time during the process have been in association with the outer air.

The filled tube exits from the second chamber 5 via an outlet of dimensions all but identical to those of the tube-section itself so as to avoid any possibility of contaminated air entering into chamber 5 from the outside. The small degree of clearance which remains will not allow passage of air inwards by virtue of the fact that pressurization of the enclosure causes egress of sterile air from within, out to the surrounding atmosphere,—never the other way about.

What is claimed:

1. A method for preparing sterilized packages containing pre-sterilized foodstuffs without the use of chemical sterilizers, comprising the steps:

bathing both sides of a continuous sheet of material in a non-sterilizing fluid;

applying superheated steam to both sides of the wetted sheet so that the wetted sheet is sterilized;

shaping the sheet into a tube;

filling the tube with pre-sterilized foodstuffs; and forming the tube into individual packages.

2. A method for preparing sterilized packages as set forth in claim 1, further comprising the steps:

after bathing the sheet, passing the sheet into a first pressurized enclosure;

after applying the superheated steam, passing the sheet into a second pressurized enclosure; and after filling the tube, passing the tube out of the second pressurized enclosure.

3. A method for preparing sterilized packages as set forth in claim 2, including the step of equalizing the pressurization of said first and second enclosures to a common value.

4. A method for preparing sterilized packages as set forth in claim 2, including the step of heating the steam to a temperature of between 130° C. and 180° C.

5. A method for preparing sterilized packages as set forth in claim 2, including the step of filling the second enclosure with sterile gas.

6. A method for preparing sterilized packages as set forth in claim 2, wherein the non-sterilizing fluid is water.

7. A method for preparing sterilized packages as set forth in claim 6, including the step of heating the water to a temperature marginally below 100° C.

8. Apparatus for preparing sterilized packages containing pre-sterilized foodstuffs without using chemical sterilizers comprising:

a first pressurized chamber, a second pressurized chamber connected to the first pressurized chambe, said second chamber being filled with a sterile gas;

bathing means for bathing both sides of a continuous sheet of material in a non-sterilizing fluid before it enters into said first chamber;

means for equalizing the pressures in said first and second chambers;

means within said first chamber for applying superheated steam to both sides of said continuous sheet;

means within said second chamber for shaping said sheet into a tube;

means for filling said tube with pre-sterilized foodstuffs; and means for forming said tube into individual packages.

9. Apparatus for preparing sterilized packages as set forth in claim 8 wherein said means for applying superheated steam comprises a plurality of spray nozzles placed along at least two rectilinear and vertical lines, said nozzles arranged to spray both sides of said sheet when said sheet is caused to pass between said lines.

10. Apparatus for preparing sterilized packages as set forth in claim 8 wherein the connection between the first and second chamber interiors is a bottleneck.

11. Apparatus for preparing sterilized packages as set forth in claim 8 wherein the means for pressure-equalization comprises an adjustable-port breather located at the upper region of said first chamber, opened and closed in response to the pressure-level within said second chamber.

* * * * *